United States Patent [19]

Knight

[11] Patent Number: 4,987,718

[45] Date of Patent: Jan. 29, 1991

[54] POLE REINFORCEMENT SYSTEM

[75] Inventor: John K. Knight, Doncaster, Australia

[73] Assignee: Eltek Holdings Pty., Ltd., Victoria, Australia

[21] Appl. No.: 378,516

[22] PCT Filed: Nov. 11, 1987

[86] PCT No.: PCTAU 871379
§ 371 Date: June 12, 1989
§ 102(e) Date: June 12, 1989

[87] PCT Pub. No.: WO88/03593
PCT Pub. Date: May 19, 1988

[30] Foreign Application Priority Data

Nov. 12, 1986 [AU] Australia ..... PH8925/86

[51] Int. Cl.[5] ..... E04G 23/04

[52] U.S. Cl. ..... 52/742; 52/170

[58] Field of Search ..... 52/170, 165, 742; 405/216

[56] References Cited

U.S. PATENT DOCUMENTS

| | | | |
|---|---|---|---|
| 877,268 | 1/1908 | Van Buren | 52/170 X |
| 1,665,995 | 4/1928 | Wiley | 52/170 |
| 1,726,371 | 8/1929 | Spring . | |
| 1,755,461 | 4/1930 | Spring | 52/170 |
| 1,784,770 | 12/1930 | Wiley | 52/170 |
| 1,789,393 | 1/1931 | Spring | 52/170 |
| 2,265,452 | 12/1941 | Ruggieri . | |
| 3,295,275 | 1/1967 | Carlsen | 52/170 X |
| 3,350,822 | 11/1967 | Nachazel | 52/170 |
| 4,280,567 | 7/1981 | Ijas . | |
| 4,598,512 | 7/1986 | Chapman | 52/170 |
| 4,697,396 | 10/1987 | Knight | 52/170 |

FOREIGN PATENT DOCUMENTS

| | | |
|---|---|---|
| 0109264A1 | 5/1984 | European Pat. Off. . |
| 819575 | 11/1951 | Fed. Rep. of Germany . |
| 85637 | 7/1920 | Switzerland . |
| 2139663A | 11/1984 | United Kingdom . |
| 2162561A | 2/1986 | United Kingdom . |
| WO85/02435 | 6/1985 | World Int. Prop. O. . |

*Primary Examiner*—Michael Safavi

*Attorney, Agent, or Firm*—Lowe, Price, Leblanc, Becker & Shur

[57] ABSTRACT

A method and apparatus for reinforcing the buried end of a wooden utility pole. The method uses elongate curved elements which are spaced about the periphery of the pole and driven into the ground so that their lower ends are buried. Bolts which pass through the pole are used to firmly clamp the members to the pole.

5 Claims, 6 Drawing Sheets

POLE REINFORCEMENT SYSTEM

This invention relates to a pole reinforcement system.

More particularly, this invention relates to a pole reinforcement system which can be used to reinforce the buried ends of wooden poles.

The general object of the invention is to provide a simple yet effective technique which can be used to reinforce the buried ends of wooden poles such as utility poles. The structural properties of utility poles can be very seriously downgraded by rotting which usually occurs a short distance beneath the ground level. The technique of the invention provides a simple yet effective technique of reinforcing the poles so as to prolong their useful life.

According to the present invention there is provided a method of reinforcing a pole, the method comprising the steps of placing a first elongate reinforcing member adjacent to the pole, said elongate member being curved in transverse cross-section so as to partly surround the periphery of the pole, driving the member downwardly so that its lower portion is embedded in the ground adjacent to the buried end of the pole, placing a second elongate member adjacent to the pole, said second elongate member being curved in transverse cross-section so as to partly surround the periphery of the pole and being located so that one edge region thereof overlaps one edge region of the first member, driving the second elongate member so that its lower portion is embedded in the ground adjacent to the buried end of the pole and fixing the first and second members to the pole.

The invention will nor be further described with reference to the accompanying drawings, in which:

FIG. 3, 4 and 4A show diagrammatically the positioning of the elongate member with respect to a pole to be reinforced.

Figure 1:
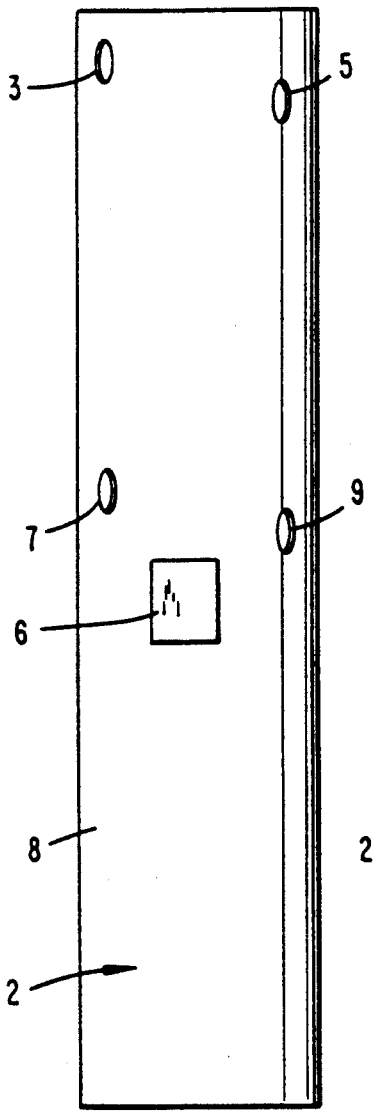
FIG. 1 is a side view of a reinforcing member of the invention.
Figure 2:
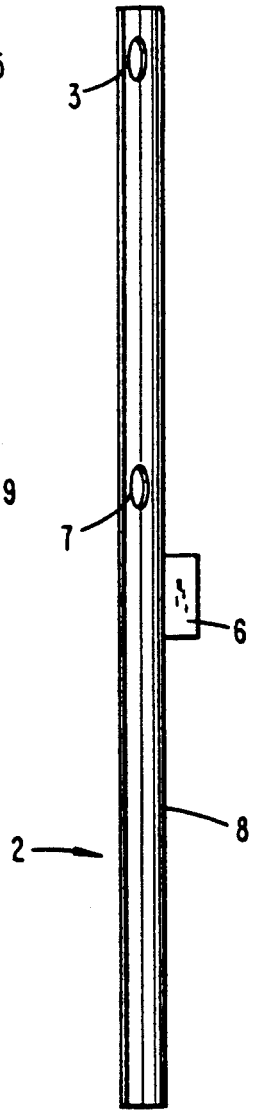
FIG. 2 is an edge view of the member.
Figure 3:
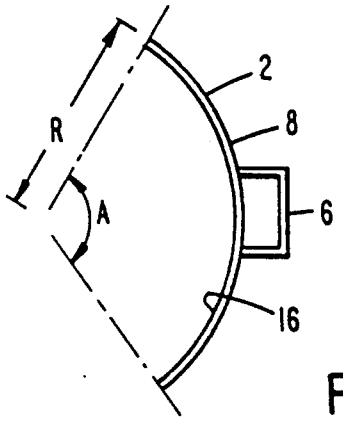
FIG. 3 is a plan view of the member.

FIGS. 1 to 3 show a preferred form of reinforcing member 2 constructed in accordance with the invention. The reinforcing member is typically three metres long and is fabricated from H.U. 280 steel and is preferably three millimetres in thickness. As seen in FIG. 2, the member 2 is curved in cross-section and the radius R is in the range from 120 to 250 mm. The member 2 subtends an angle A which is in the range 90° to 180° so that it will embrace about 20 to 40% of the periphery of a pole 4 to be reinforced. The member 2 inclues a driving lug 6 welded on the convex face 8 of the member substantially midway along the length of the member. The member has upper mounting holds 3 and 5 and central mounting holes 7 and 9.

Figure 4:
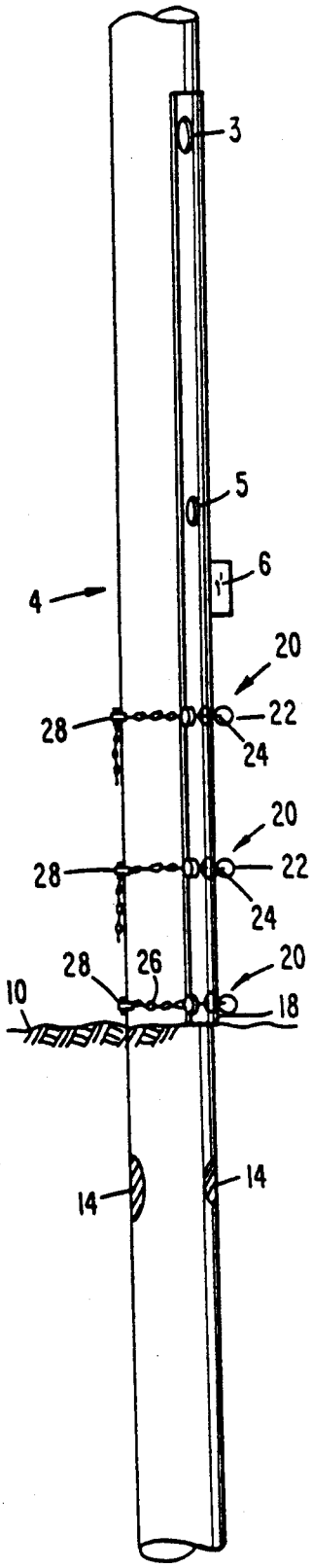
Figure 4A:
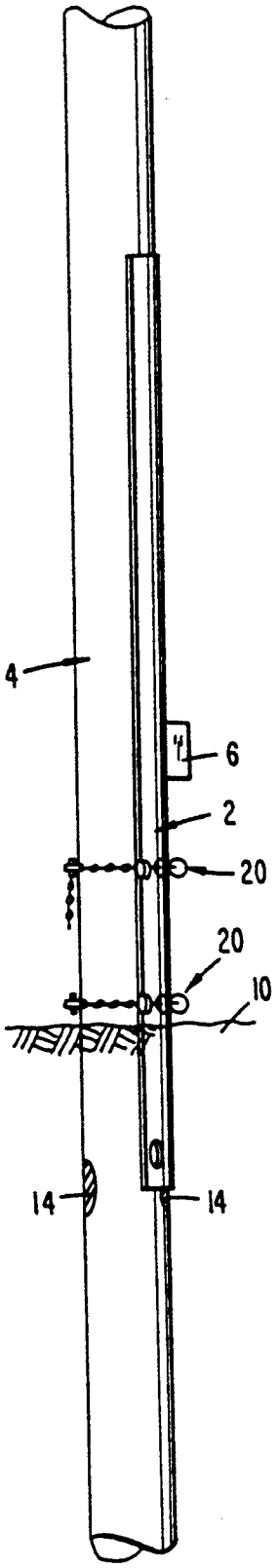
Figure 5:
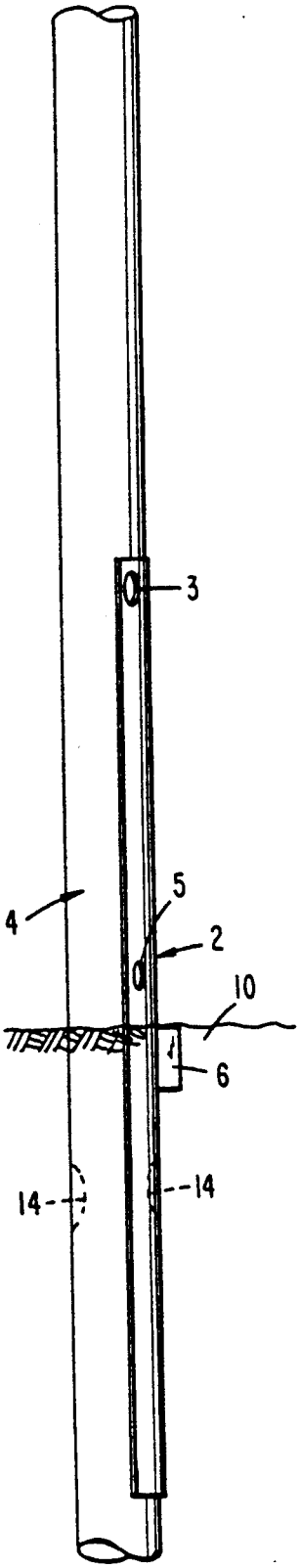
FIG. 5 shows the final position of the member.

FIGS. 4 and 5 diagrammatically illustrate driving the member 2 into the ground 10 adjacent to the buried end 12 of the pole 4. The buried end 12 may include rotted regions 14, as shown. The member 2 is placed adjacent to the pole 4 with its concave side 16 partly surrounding the pole. The lower end 18 of the member rests on the ground 10. A number of restraining bands 20 are used to hold the concave face 16 of the member adjacent to the pole whilst a driving force is applied to the lug 6. This ensures that the lower end 18 of the member penetrates the ground and remains adjacent to the surface of the buried end 12 of the pole. The restraining bands 20 may comprise rollers 22 mounted for rotation on curved shafts 24, the ends of the shafts 24 being connected to chains 26. Chain tensioning devices 28 are included so as to apply tension to the chains and thus cause the rollers 22 to very firmly hold the concave face 16 of the member 2 adjacent to the surface of the pole. As mentioned before, this ensures that the member 2 remains adjacent to the buried surface of the pole, as shown in FIG. 4. As seen in FIG. 4A, the restraining band 20 can be successively removed to permit the lug to pass to its final position just beneath the level of the ground, as shown in FIG. 5.

A number of similar reinforcing members 2 can be driven into the ground adjacent to the pole, in a similar manner.

Figure 6:
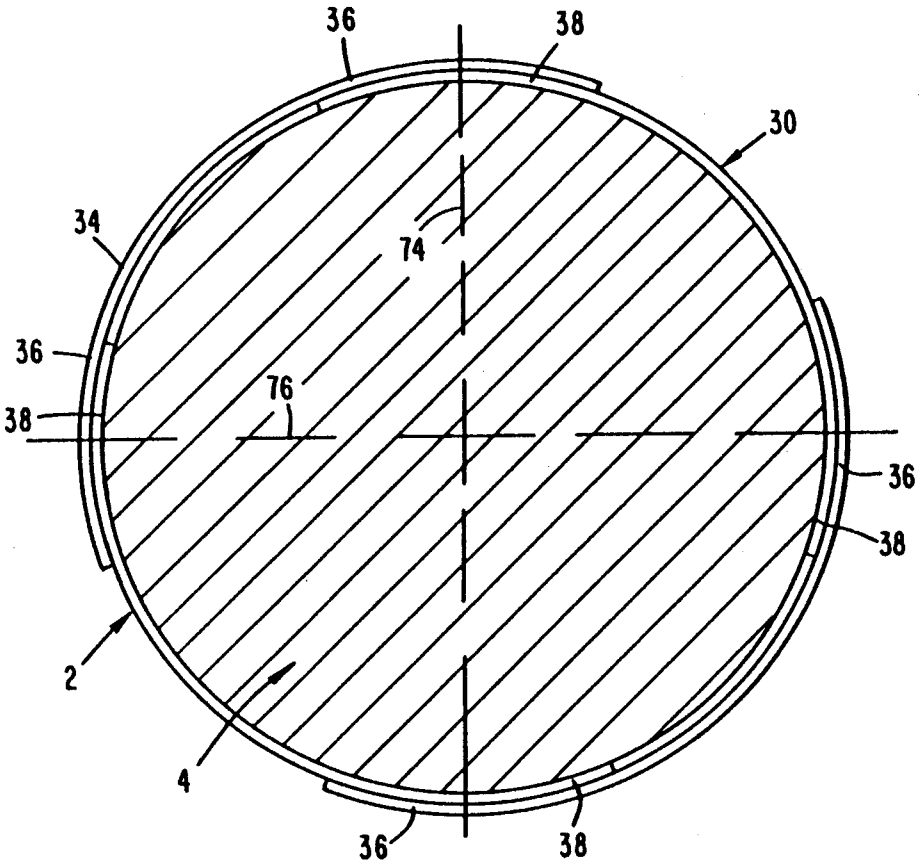
FIG. 6 is a diagrammatic cross-sectional view showing four reinforcing members surrounding the pole.
Figure 8:
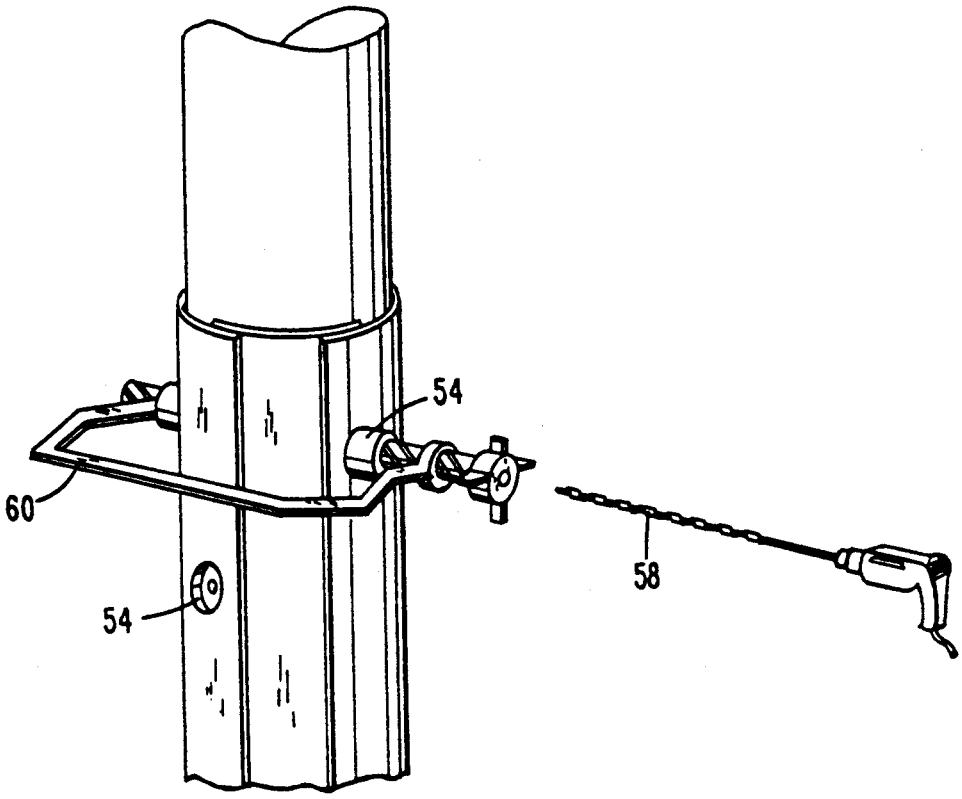
FIG. 8 illustrates a technique for boring through the pole.

FIG. 6 shows an arrangement in which a first member 2 is located at one side of the pole and a second member 30 is located diametrically opposite the first member 2. Third and fourth members 32 and 34 are provided in diametrically opposite positions and their longitudinal side portions 36 overlap adjacent side portions 38 of the first and second members 2 and 30. In this way the entire periphery of the lower and of the pole is covered by the reinforcing members. The overlapping side edge portions 36 and 38 provide additional strength and moreover provide a very firm base for mounting bolts for fixing the members to the pole.

The holes 3, 5, 7 and 9 of one member are arranged to be aligned with holes of adjacent members. Some of the members have their holes at different heights so that mounting bolts will be at different heights, as described below. Alternatively, the holes 3, 5, 7 and 9 can elongate slots so that the bolts can be located at different levels.

Figure 7:
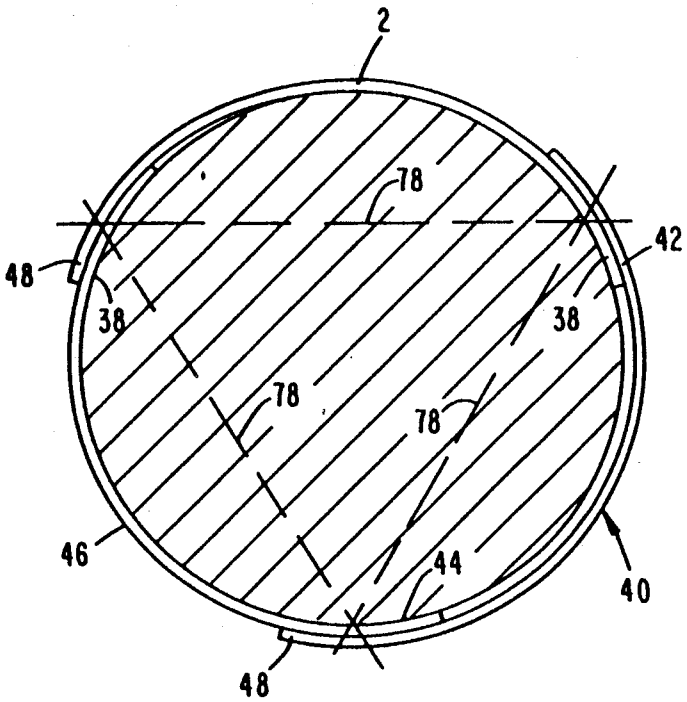
FIG. 7 shows a modified arrangement using three reinforcing members.

FIG. 7 shows an alternative arrangement where three members are sufficient to surround the periphery of the pole. In this arrangement the first member 2 is located as before, a second member 40 is located so that one of its edges 40 overlaps the edge 38 of the member 2 and the other of its edges 44 engages the pole. The third member 46 has its edges 48 overlapping the side edges 38 and 44 of the other two members. It will be appreciated that in modified arrangements a greater orf lesser number of members may be employed. Further, it is preferred that the entire periphery of the pole is surrounded by the members.

Once the members have been driven into the ground adjacent to the pole, they are then affixed to the pole so as to firmly hold them in engagement with the pole and thereby reinforce the pole. It would be possible to use straps 50 which extend about the members, as illustrated in FIG. 10. It is preferred however to use a special form of bolting arrangement which is diagrammatically illustrated in FIG. 9. In this arrangement, bolts 52 are used to securely hold the members the pole. It is first necessary to align the holes 3, 5, 7 and 9 through the overlapped edges of the members. Bores 56 are then made through the pole so as to communicate with the holes at the opposite side of the pole. The bore 56 is most conveniently accomplished by using a bit 58 in conjunction with a guide jig 60.

Figure 9:
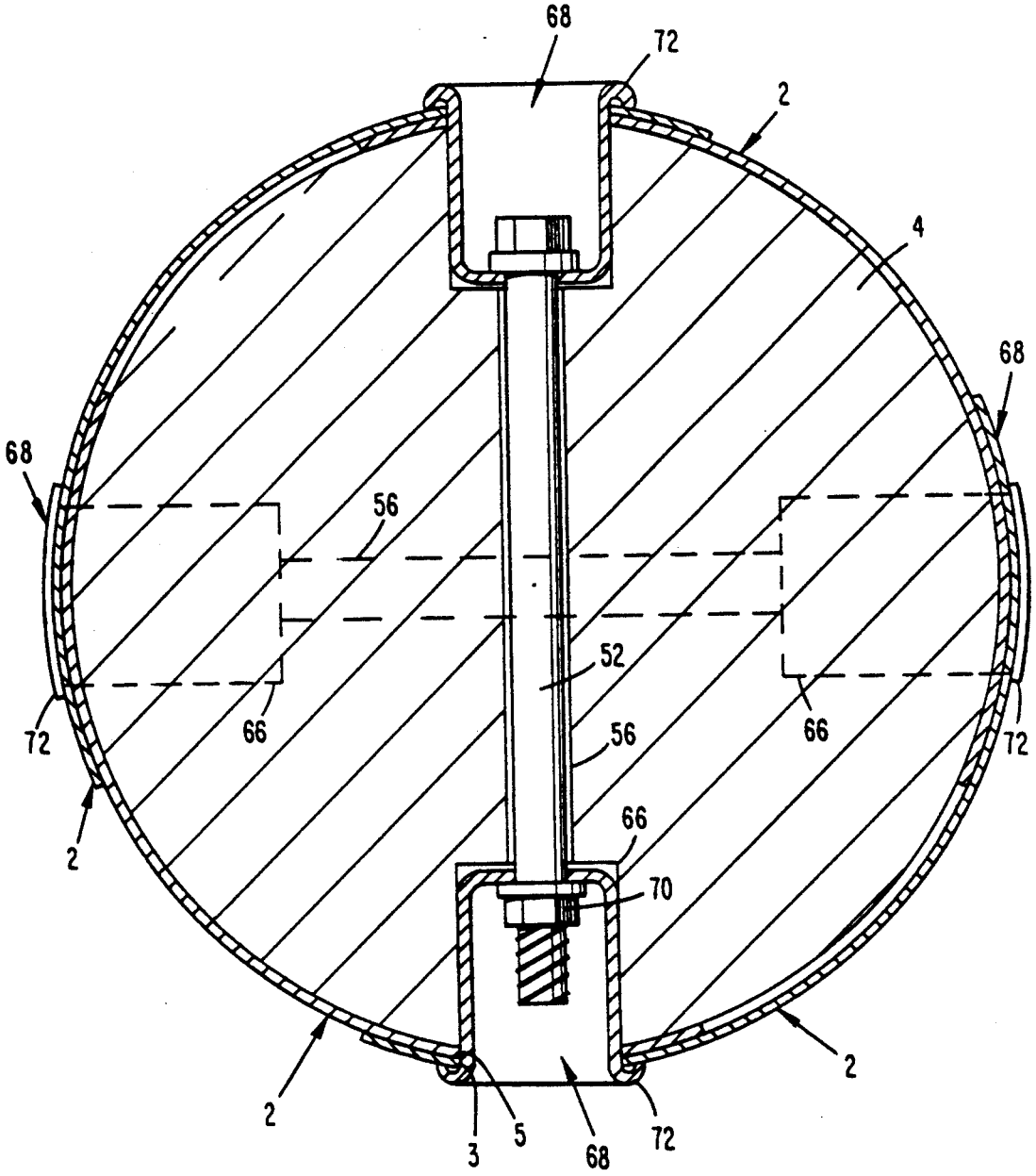
FIG. 9 shows a cross-section through the reinforced pole.
Figure 10:
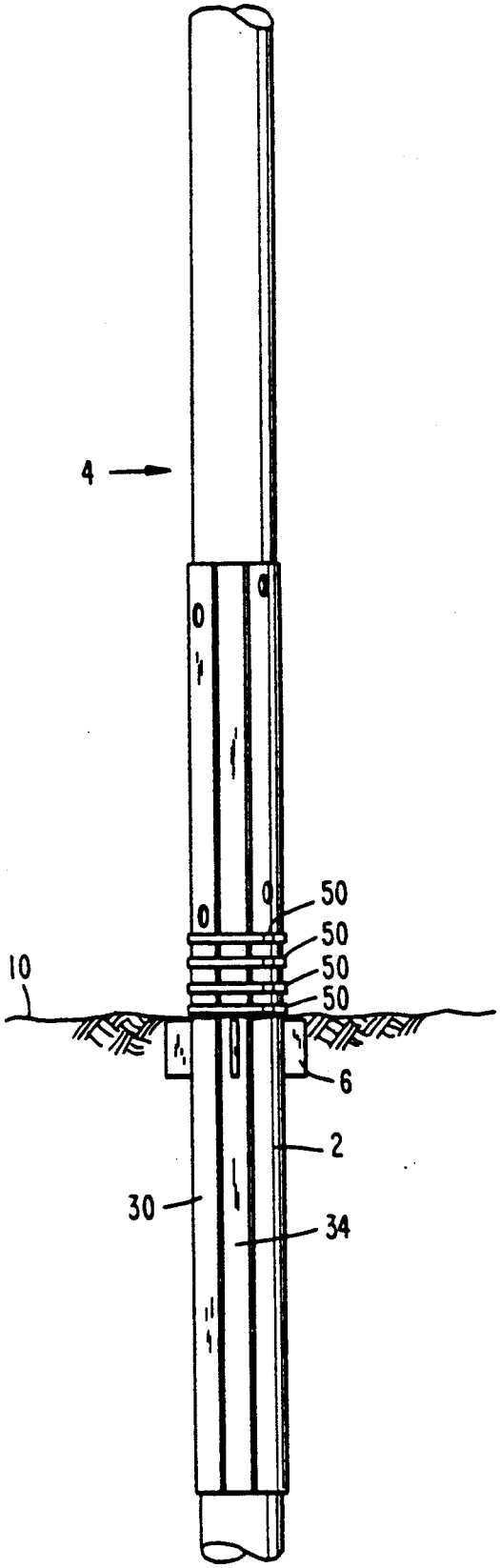
FIG. 10 shows the pole as reinforced in accordance with the invention.

The next step is to use a reamer in order to ream wide end portions 66 at either side of the pole, as shown in FIG. 9. Ferrules 68 are then inserted into the end portions 66 and a nut 70 on the bolt is tightened so as to tightly clamp the ferrules 68 towards one another. The ferrules are generally cup-shaped and have annular lip portions 72 which engage the members so that the clamping forces applied by the bolts 52 are transmitted to the members. This serves to strongly force the reinforcing members into the outer periphery of the pole and therefore very substantially increases the effective strength of the pole.

In practice a number of bolts with ferules would be used at spaced locations along the pole above ground level. As shown in FIG. 10, four such bolts are used.

FIG. 6 shows transverse lines 74 and 76 indicating the preferred positions of the axes of the bolts.

In FIG. 7 the bolts would follow lines 78. In this case three upper and three lower bolts would be used. In the arrangements of FIG. 7, a different form of ferrule (not shown) would be required which has its lip arranged at an oblique angle relative to its axis so that it would engage the surrounding parts of the members.

Finally, a number of straps 50 under tension may be located just above ground level, as illustrated in FIG. 10, in order to provide additional clamping force between the members and the pole.

Many modifications will be apparent to those skilled in the art without departing from the spirit and scope of the invention.

I claim:

1. A method of reinforcing a pole having a buried end, the method comprising the steps of placing a first elongate reinforcing member adjacent to the pole, said elongate member being curved in transverse cross-section so as partly surround the periphery of the pole, driving the member downwardly so that its lower portion is embedded in the ground adjacent to the buried end of the pole, placing a second elongate member adjacent to the pole, said second elongate member being curved in transverse cross-section so as to partly surround the periphery of the pole and being located so that one edge region thereof overlaps one edge region of the first member, driving the second elongate member so that its lower portion is embedded in the ground adjacent to the buried end of the pole and fixing the first and second members to the pole, placing a third elongate member adjacent to the pole, said third elongate member being curved in transverse cross-section so as to partly surround the periphery of the pole and being located so that edge regions thereof overlap with edge regions of both the first and second members, driving the third elongate member into the ground so that its lower end portion is embedded in the ground adjacent to the buried end of the pole and fixing the third member to the pole, and providing restraining means about the pole so as to clamp the members against the pole white they are being driven downwardly said restraining means not being connected to the members for longitudinal movement therewith.

2. A method as claimed in claim 1 wherein there are third and fourth of said members and all of said members are placed adjacent to the pole with adjacent edges regions of the members overlapping so as to surround the periphery of the pole, driving the members into the ground adjacent to the buried end of the pole, and fixing all members to the pole.

3. A method as claimed in claim 2 wherein the members (2) are fixed to the pole by bolts which pass through the pole.

4. A method as claimed in claim 3 including drilling holes (56) through the pole, enlarging end portions (66) of the holes, placing ferrules (68) through openings in the members so as to extend into said enlarged end portions, passing the bolts through the hole so that respective ends are located in ferrules on opposite sides of the pole, and tightening nuts (70) on one of the ends of each bolt.

5. A method as claimed in claim 4 including the step of placing a number of tension straps (50) about the members so as to clamp the members to the pole.

* * * * *

UNITED STATES PATENT AND TRADEMARK OFFICE

CERTIFICATE OF CORRECTION

PATENT NO. : 4,987,718

DATED : January 29, 1991

INVENTOR(S) : John K. Knight

It is certified that error appears in the above-identified patent and that said Letters Patent is hereby corrected as shown below:

Title page:

Item [86] PCT No.:, change "PCTAU 871379" to --PCT/AU87/00379--

Signed and Sealed this

Eighteenth Day of August, 1992

*Attest:*

DOUGLAS B. COMER

*Attesting Officer*

*Acting Commissioner of Patents and Trademarks*